United States Patent [19]

Ozawa

[11] 4,221,076

[45] Sep. 9, 1980

[54] TOY VEHICLE AND TRACKWAY

[75] Inventor: Shoji Ozawa, Tokyo, Japan

[73] Assignee: Tomy Kogyo Co., Inc., Japan

[21] Appl. No.: 42,494

[22] Filed: May 25, 1979

[51] Int. Cl.[3] ..... A63H 19/00

[52] U.S. Cl. ..... 46/216

[58] Field of Search ..... 46/257–263, 46/202, 216; 104/53, 63, 64, 67

[56] References Cited

U.S. PATENT DOCUMENTS

| | | | |
|---|---|---|---|
| D. 220,577 | 4/1971 | Arai | D34/15 |
| D. 224,089 | 7/1972 | Takeuchi | D34/15 |
| D. 226,957 | 5/1973 | Arai | D34/15 MM |
| D. 246,196 | 10/1977 | Suzuki | D34/5 CC |
| D. 248,888 | 10/1978 | Sato | D34/15 K |
| 3,540,153 | 11/1970 | Aoki | 46/261 |
| 3,589,064 | 6/1971 | Harada | 46/216 X |
| 3,613,306 | 10/1971 | Arai | 46/216 |
| 4,068,402 | 1/1978 | Tanaka | 46/216 |
| 4,100,696 | 7/1978 | Ogasawara | 46/216 X |
| 4,109,412 | 8/1978 | Saito | 46/216 |

FOREIGN PATENT DOCUMENTS

| | | | |
|---|---|---|---|
| 2333410 | 7/1977 | France | 46/216 |
| 1427941 | 3/1976 | United Kingdom | 46/202 |

*Primary Examiner*—F. Barry Shay

*Attorney, Agent, or Firm*—Staas & Halsey

[57] ABSTRACT

An amusement device consisting of a toy wheeled vehicle and a trackway on which the vehicle moves. In the preferred embodiment, the wheeled vehicle has at least rotatably driven rear wheels, rotatably driven gears and at least one rod extending from the vehicle. The trackway includes six different track sections which, when cooperating with the vehicle, impart different types of movements to the vehicle as the vehicle moves along the trackway. In one track section, for example, the front end of the vehicle is elevated into an upwardly extending position. The vehicle is movably driven on the track section by the rear wheels in the upwardly extended front end position until it reaches a portion of the track section which returns the front end of the vehicle to a normal position. In another track section, there is provided a double-inclined tower which imparts a rocking movement to the vehicle as the vehicle moves upwardly on one side of the tower. As the vehicle moves downwardly on the opposite side of the tower, the vehicle rotates in a somersault fashion about the gears from gravity and vehicular mass momentum until the vehicle reaches the trackway at the tower bottom. In yet another track section, the vehicle is imparted with an S-shaped movement along that section. In still a further track section, the vehicle is tilted sideways and moved along the section in that tilted position until it is returned to its normal position on the trackway. In still another track section, there is a tower which the vehicle climbs substantially vertically upward to an elevated level and then somersaults from a spring-action ramp at that elevated level onto the trackway below to a normal position.

18 Claims, 13 Drawing Figures

TOY VEHICLE AND TRACKWAY

BACKGROUND OF THE INVENTION

This invention relates to an amusement device. More particularly, this invention relates to a toy wheeled vehicle and a trackway wherein the cooperation of the vehicle and trackway imparts certain movements to the vehicle as it moves along the trackway.

Toy vehicle and trackway devices for children are popular. These amusement devices must capture the interest of the child and maintain that interest for a reasonable period of time of play, must be entertaining for children of different age levels, and must be durable and simple in configuration to insure the safety of the children who play with the device.

SUMMARY OF THE INVENTION

Accordingly, it is a primary object of this invention to provide an amusement device of a toy wheeled vehicle and trackway wherein various movements are imparted to the vehicle along the trackway capturing the interest of the child and maintaining that interest for a reasonable period of time of play.

It is another object of this invention to provide a toy vehicle and trackway which is entertaining for children of different age levels.

Still another object of this invention is to provide a toy wheeled vehicle and trackway with the features set forth above which is durable and simple in construction to ensure the safety of the child who is playing with the toy.

Additional objects and advantages of the invention will be set forth in part of the description which follows, and in part will be obvious from the description, or may be learned by practice of the invention. The objects and advantages of the invention may be realised and obtained by means of the instrumentalities and combination particularly pointed out in the appended claims.

To achieve the foregoing objects and in accordance with the purpose of the invention, as embodied and broadly described herein, the amusement device comprises a toy wheeled vehicle and a trackway having different track sections on which the vehicle moves, wherein the cooperation of the vehicle and trackway sections imparts different movements to the vehicle as it moves along the trackway.

In the preferred embodiment of the amusement device, the wheeled vehicle includes at least rotatably driven rear wheels, rotatably driven gears extending from the vehicle, and at least one rod extending from the vehicle. The trackway on which the vehicle moves includes (a) a first track section having at one end side ramps and teeth means positioned on the side ramps engageable with the rotatably driven gears of the vehicle for elevating the front end of the vehicle into an upwardly extending position, the vehicle being movably driven on the trackway by the rear wheels in the upwardly extended front-end position after leaving the side ramps and teeth means, and wherein the track section has at another end step means for imparting a change of movement to the vehicle to return the front end of the vehicle to a normal position on the trackway; (b) a second track section having a double-inclined tower with upstanding side portions, wherein the upstanding side portions along the first inclined tower section are provided with continuous racks positioned to be engaged by the rotatably driven gears of the vehicle to impart upward movement to the vehicle and with at least one upstanding side portion being provided with cam means engageable with the vehicular rod for imparting rocking movement to the vehicle as the vehicle moves upwardly, and wherein the upstanding side portions along the second inclined tower section are provided with continuous racks positioned to be engaged by the rotatably driven gears of the vehicle to impart downward movement to the vehicle and with a first end of at least one side portion being provided with cam means engageable with the vehicular rod for imparting a steady downward movement to the vehicle wherein when the vehicular rod disengages the cam means, the vehicle rotates about the gears from gravity and vehicular mass momentum as the vehicle moves downwardly to the trackway at the tower bottom; (c) a third track section of an S-shaped configuration having a series of substantially vertically-extending poles positioned along the sides of the track section to be engaged by said gears extending from said vehicle to impart S-shaped movement of the vehicle along the third track section; (d) a fourth track section having at one end a side ramp engageable with the wheels on one side of the vehicle for elevating the one vehicular side into an upwardly tilted position, the vehicle being moved on the trackway and maintained in the tilted position after leaving the side ramp by the driven gear and wheels on the downwardly positioned other side of the vehicle, and wherein the fourth track section has at another end a side ramp engageable with the driven gear on the downward other side of the vehicle for returning the vehicle from its tilted side position to a normal position on the trackway; and (e) a fifth track section having a tower with side portions provided with continuous racks substantially vertically positioned to be engaged by the vehicle and with at least one side portion being provided with cam means engageable with the vehicular rod for imparting a steady substantially vertically upward movement to the vehicle to an elevated level of the tower, and wherein the tower has at the elevated level a ramp extending from and rotatably attached at one end to the tower, the ramp being normally biased in a substantially horizontal position for movement of the vehicle from the tower onto the ramp and having an upright outer plate engageable with the front end of the vehicle to somersault the vehicle rearend first to a normal position onto the trackway at the tower bottom when the weight of the vehicle causes the ramp to move downwardly.

Preferably, the fifth track section includes a resilient pad means positioned on the track at the tower bottom for receiving the somersaulting vehicle and facilitating the vehicle's return to a normal position on the trackway.

It is further preferred that the trackway comprise a sixth track section with a series of steps in a downward slope to impart a bumpy movement to the vehicle along the trackway, with the first section intersecting the sixth section, the sixth section intersecting the second section, the second section intersecting the third section, the third section intersecting the fourth section, the fourth section intersecting the fifth section, and the fifth section intersecting the first section.

Finally, it is preferred that the first, second and fourth track sections be substantially horizontal, the fourth track section curved, and the vehicular rod extending from the axle of one of the vehicular rear wheels.

BRIEF DESCRIPTION OF THE DRAWINGS

The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENT

Figure 1:
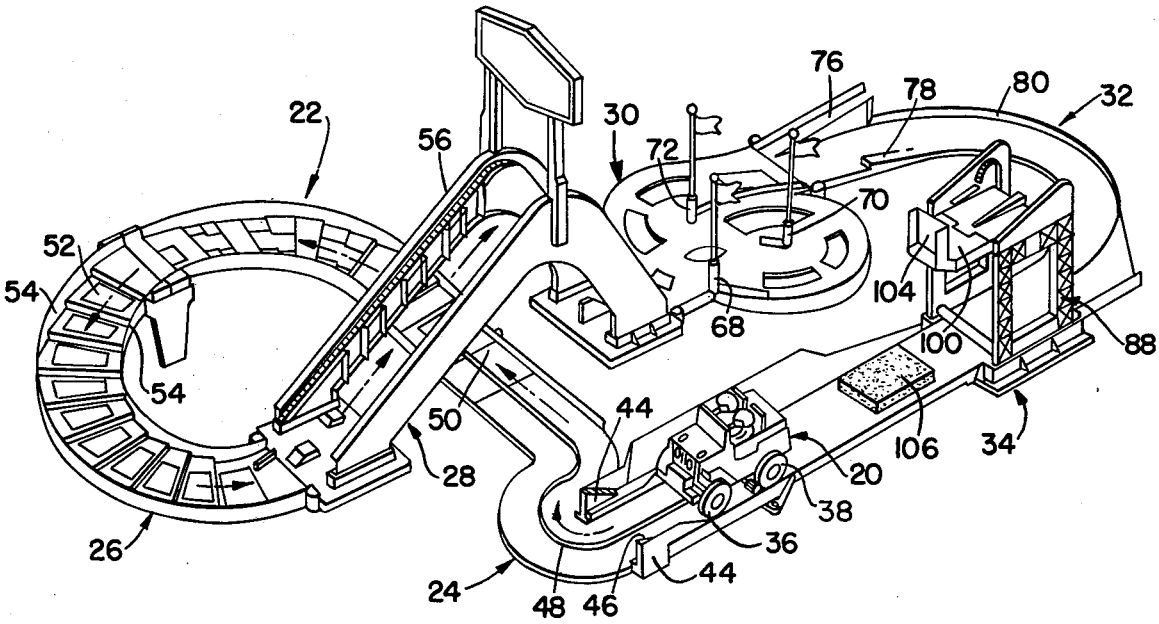
FIG. 1 is a prospective view of a preferred embodiment of the toy vehicle and continuous trackway in accordance with the invention, generally illustrating the different track sections along which the vehicle moves.

Reference will now be made in detail to the present preferred embodiment of the invention, an example of which is illustrated in the accompanying drawings.

In accordance with the invention, the amusement device comprises a toy vehicle and a trackway along which the vehicle moves. As embodied and shown in FIG. 1, the reference numeral 20 designates the toy vehicle and the reference numeral 22 designates the trackway. Trackway 22 is provided with various track sections 24, 26, 28, 30, 32, and 34 in a continuous path along which the vehicle moves.

Figure 2:
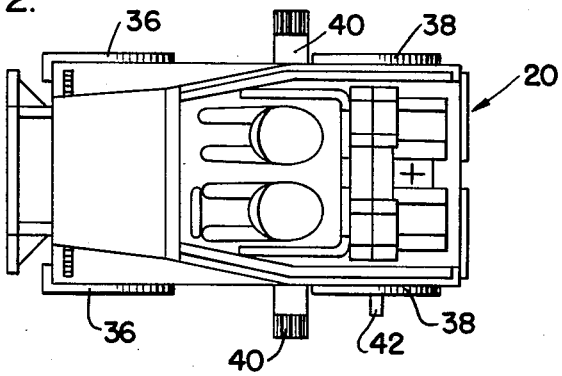
FIG. 2 is a top plan view of the toy wheeled vehicle shown in FIG. 1, illustrating in particular the rotatably driven gears and at least the one rod extending from the vehicle.

The toy vehicle 20, as best seen in FIGS. 1 and 2, is provided with a pair of front wheels 36 and a pair of rear wheels 38. Preferably the front wheels 36 are suitably mounted on the vehicular body to freely rotate while the rear wheels 38 are rotatably driven. The toy vehicle also has rotatably driven gears and at least one rod extending from the vehicle. Preferably the rotatably driven gears comprise a pair of gears 40 extending from respective sides of the vehicle, and the rod comprises a rod 42 extending from the axle of the left rear wheel 38.

To rotatably drive the rear wheels 38 and gears 40, a miniature motor of conventional configuration well known in the art is provided in the vehicle. This motor may be electrically powered by batteries or mechanically energized by springs and is operatively connected to the rear wheels 38 and gears 40.

The purpose of using rotatably driven rear wheels 38 and gears 40, and the vehicular rod 42, will be described in greater detail hereinafter. As will become apparent and as seen in FIG. 1, however, the vehicle 20 is driven along the continuous trackway 22 and is imparted with different movements due to the intercooperation of the vehicle 20 and its components with the track sections of the trackway 22 and their components.

It was previously noted that the trackway 22 comprises six different track sections 24, 26, 28, 30, 32, and 34 which are provided in a continuous path along which the vehicle 20 moves. For purposes of describing the preferred embodiment of the amusement device and its operation, the location of the toy vehicle shown in FIG. 1 will be considered as the beginning portion of the trackway 22 for the movement of the vehicle 20.

Figure 3:
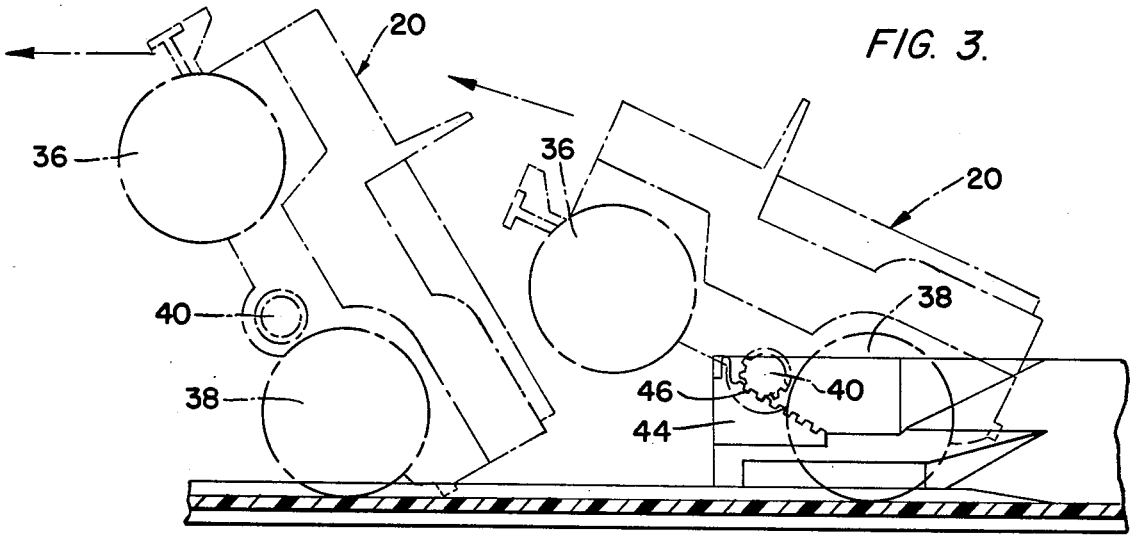
FIG. 3 is a side view of a first portion of one track section of the trackway shown in FIG. 1, illustrating in particular the side ramps and teeth means positioned on the side ramps engageable with the rotatably driven gears of the vehicle for elevating the front end of the vehicle into an upwardly extending position.

When the motor of the vehicle is activated, the vehicle 20 is driven by its rear wheels on the trackway until it enters the track section 24. As best seen by reference to FIGS. 1 and 3, track section 24 has at its first end a pair of side ramps 44 and teeth means 46 positioned on the side ramps 44 which are engageable with the rotatably driven gears 40 of the vehicle 20 for elevating the front end of the vehicle 20 into an upwardly extended position. The width or distance between the two side ramps 44 is sufficient to allow clearance of the wheels 36 and 38 of the vehicle while the teeth means 46 engage with the vehicle gears 40.

As the driven gears 40 of the vehicle reach the upper portion of the teeth means 46 on the ramps 44, the vehicle is in its upwardly extended position and is then moved from the ramp 44 by the rotatably driven rear wheels 38. The center of gravity of the vehicle is such that the upwardly extended position of the vehicle is maintained after leaving ramps 44 at the same time the vehicle is being driven along the middle portion of the track section 24 by the rear wheels 38. As shown in FIG. 1, the track of first section 24 can be provided along its center with a rail 48 which is engageable with corresponding guide means on the rearward bottom portion of the vehicle 20. This serves to guide the vehicle 20 along the first track section 24. By doing so, it is apparent that the configuration of the first track section can be varied to impart different directions to the vehicle. In the preferred embodiment track section 24 is substantially horizontal and consists of both curved and straight portions.

Figure 4:
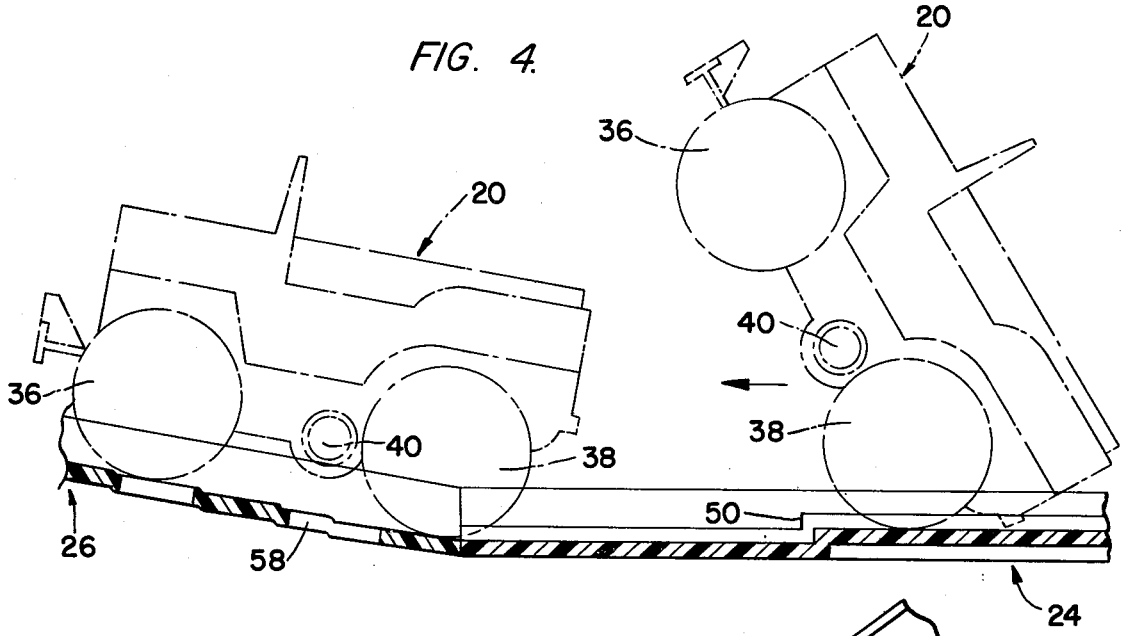
FIG. 4 is a side view of a second portion of the same track section referred to with respect to FIG. 3, illustrating in particular the step means for asserting a frontward momentum to the upwardly extended vehicle to return the front end of the vehicle to a normal horizontal position on the trackway.

As best illustrated in FIGS. 1 and 4, the first track section 24 has at its final end step means 50 located on the track for returning the upwardly extended vehicle 20 to a normal horizontal position. This is achieved when the rear wheels 38, which are driving the upwardly extended vehicle 20 along the track, move across the step means 50. The action causes a frontward momentum so that the vehicle is again positioned in a normal manner on the trackway as illustrated in the lefthand side of FIG. 4.

As illustrated in FIGS. 1 and 4, as the vehicle 20 leaves track section 24, it enters the connected track section 26. Movement of the vehicle along the track section 26 is provided by the rotatably driven rear wheels 38. As best shown in FIG. 1, the second track section 26 comprises a series of steps along upwardly and downwardly inclined track portions to impart a bumpy movement to the vehicle 20 as it moves therealong. In the preferred embodiment, track section 26 has a circular-like configuration. To ensure proper movement of the vehicle along this path, side guide rails 54 are provided.

As the vehicle 20 leaves track section 26, it enters the connected track section 28 which is provided with a double-inclined tower 56. As illustrated in FIG. 1, the double-inclined tower 56 has a first upwardly inclined tower section and a second downwardly inclined tower section. Upstanding portions 58 provided on the sides of the upwardly inclined tower section each have a continuous rack of teeth 60 and and a rail 62 spaced therefrom. When the vehicle 20 enters the double-inclined tower 56 from the track section 24, it will be apparent from the configuration of the racks of teeth 60 and rails 62 of the upstanding side portions 58 that the gears 40 engage the racks of teeth 60. Rotation of the gears 40 along the racks 60 causes the vehicle 20 to move upwardly along the racks 60, it being understood that the rails 62 function principally to confine the rotating gears 40 into engagement with the racks 60.

Figure 5:
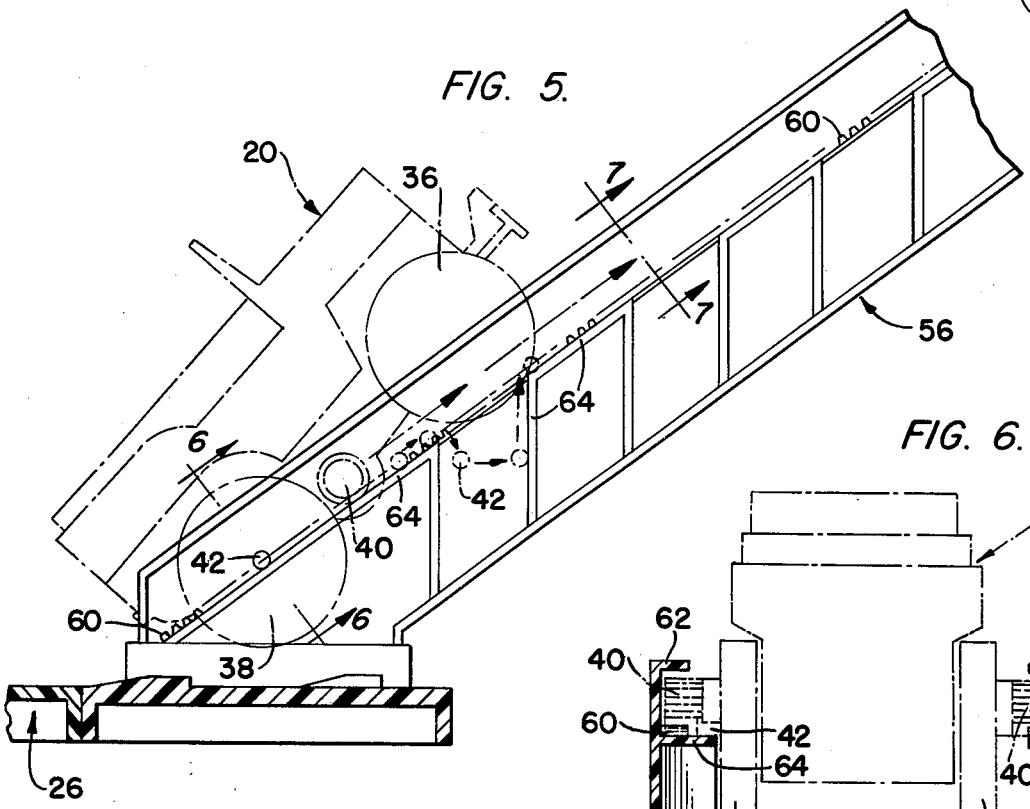
FIG. 5 is a side and partial cross-sectional view of a second track section of the trackway shown in FIG. 1, illustrating in particular the upwardly inclined tower portion of the double-inclined tower with upstanding side portions having continuous racks of teeth positioned to be engaged by the rotatably driven gears of the vehicle to impart upward movement to the vehicle and cam means engageable with the vehicular rod for imparting a rocking movement to the vehicle as the vehicle moves upwardly.
Figure 6:
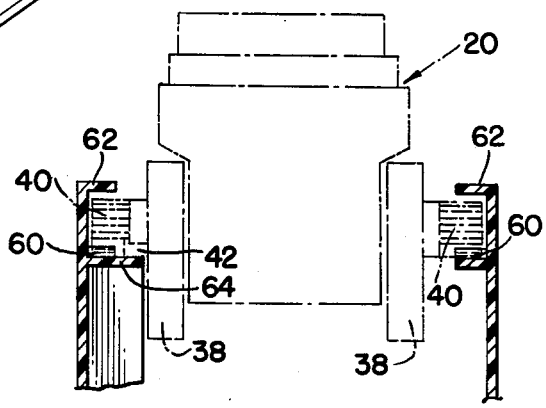
FIG. 6 is a fragmented cross-sectional view of the toy vehicle and the upstanding portions of the double-inclined tower taken along the line 6—6 in FIG. 5, illustrating in particular the interaction of the rotatably driven gears and the vehicle rod of the vehicle respectively with the teeth racks and cam means on the side portions of the tower.
Figure 7:
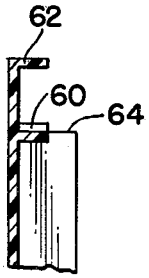
FIG. 7 is a fragmented cross-sectional view of one of the upstanding side portions of the double-inclined tower taken along the line 7—7 in FIG. 6, illustrating in particular the continuous teeth racks and the cam means on the side portion of the tower for engagement respectively with one of the gears and the rod of the vehicle.

In addition to the above, the first upwardly inclined tower section of tower 56 has cam means provided on at least one of the upstanding side portions 58 engageable with the rod 42 of the vehicle 20 for imparting a rocking movement to the vehicle as the vehicle moves upwardly. As herein embodied and as shown in FIGS. 1 and 5, the cam means comprises a lower cam guide rail 64 which is non-continuous and interrupted by spaces and extends from the leftward upstanding side portion 58. As the vehicle 20 is driven upwardly by the gears 40 in engagement with the racks of teeth 60, the vehicular rod 42 moves along the cam guide rail 64. This results in a steady upward movement of the vehicle until the vehicular rod 42 disengages with the guide rail 64. When the rod 42 enters one of the series of spaces, a downward rocking movement is imparted to the vehicle 20 until the rod reengages with the next sequential guide rail 64. This is best illustrated in the side view of FIG. 5 showing the vehicular rod 42 in cooperation with the guide rail 64 as the vehicle moves upwardly along the tower 56. This intercooperation is further shown in the rear view of FIG. 6 taken along the line 6—6 of FIG. 5.

Figure 8:
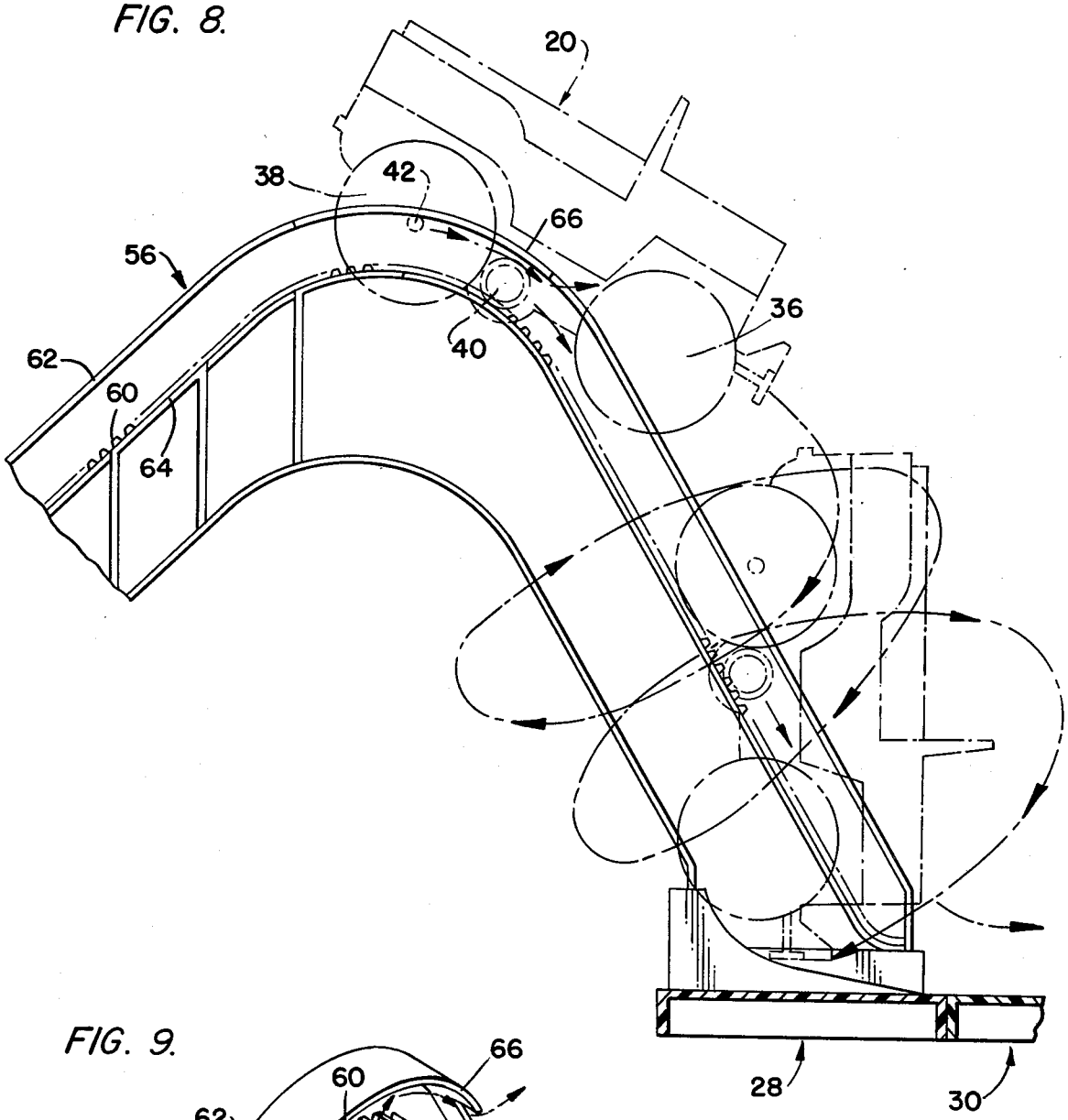
FIG. 8 is a side and partial cross-sectional view of the same track section referred to with respect to FIG. 5, illustrating in particular the top and downwardly inclined tower portions of the double-inclined tower and the interaction of the rotatably driven gears of the vehicle with the continuous racks of teeth positioned along the upstanding side portions and the engagement and disengagement of the rod of the vehicle with the cam means for allowing the vehicle to somersault about its gears from gravity and vehicular mass momentum as the vehicle moves downwardly to the tower bottom.
Figure 9:
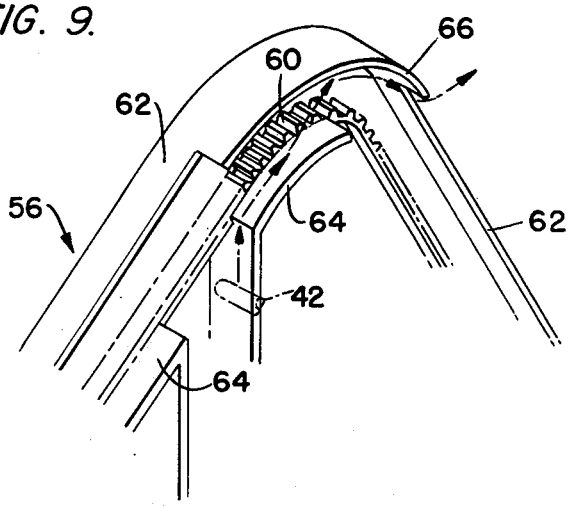
FIG. 9 is a fragmented prospective view of the top portion of the double inclined tower of the track section referred to in FIGS. 5 and 8, illustrating in particular the continuous racks and cam means of one of the upstanding portions of the tower and the interaction of the vehicular rod with the cam means as the vehicle moves from the upwardly inclined tower portion to the downwardly inclined tower portion.

As illustrated in FIGS. 8 and 9, the second downwardly inclined tower section also has upstanding side portions 58 each having a continuous rack of teech 60 and a rail 62 spaced therefrom. When the vehicle 20 is in the downwardly inclined section of the tower 56, it will be apparent from the configuration of the racks of teeth 60 and rails 62 that the gears 40 of the vehicle engage the racks of teeth 60. Rotation of the gears 40 along the racks 60 causes the vehicle 20 to move downwardly along the racks 60, it being again understood that the rails 62 function principal-16 to confine the rotating gears 40 into engagement with the racks 60.

As herein embodied, at least one side portion 58 of the downwardly inclined tower section is provided at a first end with cam means engageable with the vehicular rod 42 for imparting a steady downward movement to the vehicle. Preferably, and as best shown in FIGS. 8 and 9, this cam means comprises an upper cam rail 66 along which the vehicular rod 42 moves. When the vehicle 20 reaches the upper end of the upwardly inclined section of the tower 56, the vehicular rod 42 leaves the last lower cam rail 64 and by virtue of the center of gravity and the momentum of the vehicle into a downward position, the vehicular rod 42 moves into cooperation with the upper cam rail 66. The vehicle 20 will then continue to move in a steady downward movement as long as the vehicle rod 42 is in engagement with the upper cam rail 66.

As was previously mentioned, only the first end of the downwardly inclined section of the tower 56 is provided with the upper cam rail 66. Accordingly, with the body of the vehicle 20 being freely rotatable about the driven vehicular gears 40 that are engaged with the racks 60 and when the vehicular rod 42 disengages the end of the upper cam rail 66, the vehicle somersaults front end first due to gravity an vehicular mass momentum. As the vehicle 20 steadily moves downwardly to the tower bottom from engagement of the gears 40 and with racks 60, the vehicle will continue to somersault front end first. This is best illustrated in FIG. 8. In the preferred embodiment, the vehicle 20 is imparted with three somersaults and reaches the bottom of the tower with the front end of the vehicle 20 facing the track at the tower bottom. As will be seen from FIG. 8, the lower portion of the tower is formed in a curved configuration to facilitate the movement of the vehicle 20 from a downward position to a substantially horizontal position of the vehicle on the track.

The number of somersaults and position of the vehicle in the above operation is, of course, dependent upon such design factors as degree of inclination and length of the tower section, the location on the tower section at which the upper cam rail 66 ends, and the weight and center of gravity of the vehicle 20.

After the vehicle 20 reaches the bottom of the tower 56 and leaves the track section 28, it enters a track section 30 of an S-shaped configuration. As herein embodied, track section 30 includes a series of substantially vertically-extending poles positioned along the sides of the track section to be engaged by the rotatably driven gears 40 extending from the vehicle 20 to impart an S-shaped movement of the vehicle along the track section.

Figure 10:
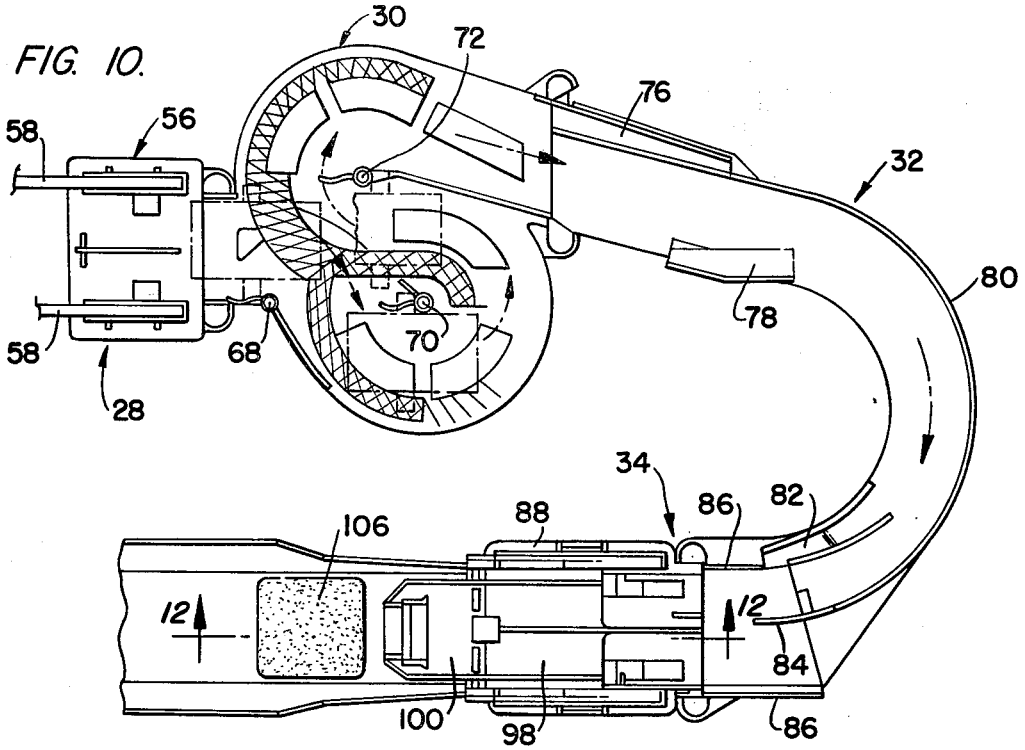
FIG. 10 is a top plan view of the trackway shown in FIG. 1, illustrating in particular three additional track sections for imparting different movements to the toy vehicle after it leaves the double-inclined tower.

Preferably, the substantially vertically-extending poles comprise a series of three poles 68, 70, and 72, positioned along the S-shaped track section 30 in the manner illustrated in FIGS. 1 and 10. With this configuration, when the vehicle 20 leaves the tower 56, the gear 40 on the right side of the vehicle 20 hits the first pole 68 on the right side of the S-shaped track section 30. Because the rear wheels 38 are driving the vehicle 20 on the track at this time while the right gear 40 abuts against the first pole 68, the vehicle is moved rightwardly until the gear 40 on the left side of the vehicle hits the next pole 70 positioned on the left side of the track. In a similar fashion, because the rear wheels 38 are still driving the vehicle 20 on the track while the leftward gear 40 abuts the pole 70, the vehicle is moved leftwardly. This action continues until the rightward gear 40 of the vehicle 20 abuts the third pole 72 sequentially positioned along the right side of the track. A rightward movement again is imparted to the vehicle 20 until the rightward gear 40 disengages from the pole 72. To ensure that the vehicle 20 is imparted with an S-shaped movement along the S-shaped track section 30, side guide rails 74 as shown in FIGS. 1 and 10 are provided along the track and the track is formed with appropriate inclinations along the different curves of the S-shaped configuration.

As the vehicle 20 leaves the end of the track section 30, it enters track section 32. The features of track section 32 are best illustrated by reference to FIGS. 1, 10 and 11. As herein embodied, track section 32 has at its first end a side ramp 76 engageable with the wheels on one side of the vehicle 20 for elevating that one vehicular side into an upwardly tilted position. Preferably side ramp 76 is positioned on the left side of the track section 32 wherein the wheels 36 and 38 on the left side of the vehicle 20 move up the side ramp 76 until that side is in an upwardly tilted position. To ensure that the vehicle is smoothly moved into this tilted position, a secondary side ramp 78 having a downward inclination is located on the right side of the track section 32 wherein the gear 40 on the right side of the vehicle is moved downwardly onto the track of section 32. The vehicle is balanced in its upwardly tilted position by the driven gear 40 and wheels 36 and 38 on the downwardly positioned or right side of the vehicle 20 resting on the track.

By virtue of the rear wheel 38 and gear 40 on the right side of the vehicle 20 being driven along the track, the vehicle moves along the track in an upwardly tilted position until it reaches the other end of the track section 32. Preferably, the track section 32 is formed in a curved horizontal configuration and provided with an outer leftward side guide rail 80. The wheels on the right side of vehicle 20 abut against rail 80 while travelling along the track so that the vehicle in its tilted position is imparted with a movement around the curved track until it reaches the other end.

Figure 11:
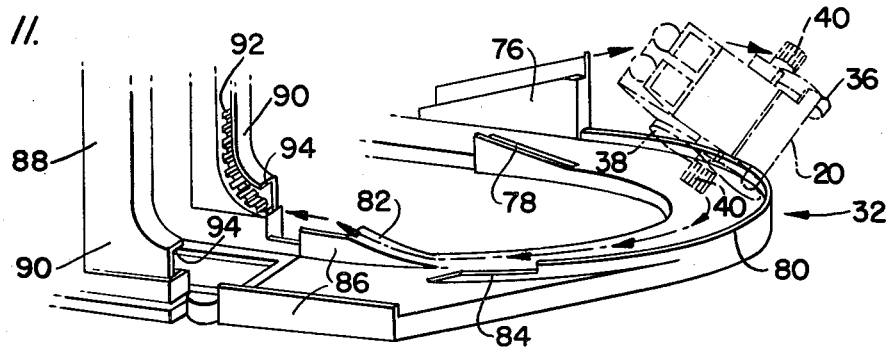
FIG. 11 is a fragmented prospective view of a track section of the trackway shown in FIGS. 1 and 10, illustrating in particular the first side ramp engageable with the wheels on one side of the vehicle for elevating one vehicular side into a tilted position with the vehicle being moved on the track section in the tilted position after leaving the side ramp until reaching the second side ramp which is engageable with the driven gear on the downward side of the vehicle for returning the vehicle from the tilted position to a normal horizontal position on the track section and for entry of the vehicle into the next sequential track section.

As best seen in FIG. 11, there is provided at the other end of the track section 32 an upwardly inclined side ramp 82 for engagement with the gear 40 on the right side of the vehicle 20. As the vehicle 20 reaches ramp 82, the gear 40 moves upwardly along ramp 82, and in doing so, causes the vehicle to be returned from its tilted side position to a normal horizontal position on the track section 32. To ensure that the gear 40 is aligned for engagement with side ramp 82 and the vehicle 20 is aligned for entry into the next track section 34, a center guide rail 84 and side guide rails 86 are provided at that end of the track section 32 to position the vehicular wheels and thus the vehicle into a proper location.

It will be apparent from FIGS. 1 and 11 that the next track section 34 has a tower 88. The tower 88 comprises side portions 90 provided with continuous racks of teeth 92 substantially vertically positioned for engagement by the rotatably driven gears 40 of the vehicle 20 to impart an upward movement to the vehicle to an elevated level of the tower. A rail 94 is spaced from each of the continuous racks of teeth 92 on each of the side portions 90, it being understood that the rails 94 function principally to confine the rotatably driven gears 40 of the vehicle into engagement with the racks of teeth 92. Rotation of the driven gears 40 along the racks 92 causes the vehicle 20 to move upwardly along the racks 92. At the elevated level of the tower 88, hereinafter designated by reference numeral 98, the racks of teeth 92 and rails 94 are curved to move the vehicle into a substantially horizontal position on that elevated level 98.

Figure 12:
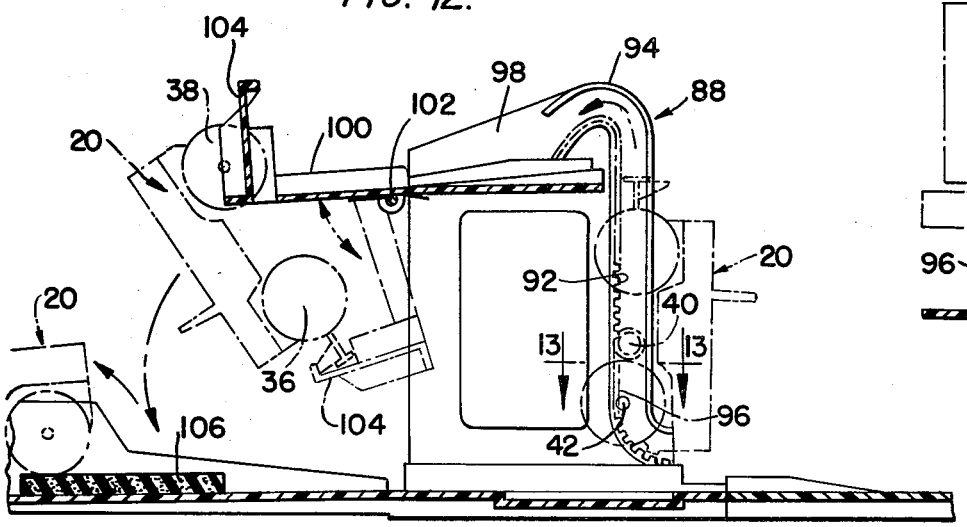
FIG. 12 is a side and partial cross-sectional view of the track section of the trackway taken along line 12—12 of FIG. 10, illustrating in particular the tower with side portions provided with substantially vertical continuous racks of teeth and cam means to engage respectively with the rotatably driven gears and the rod of the toy vehicle for upward movement of the vehicle to the elevated tower level and the ramp extending from and rotatably attached to the elevated tower level, the ramp being biased in a horizontal position to receive the toy vehicle from the tower and having an upright outer plate engageable with the front end of the vehicle to somersault the vehicle rear end first to a normal horizontal position at the tower bottom when the weight of vehicle causes the ramp to move downwardly; and, FIG. 13 is a fragmented cross-sectional view of the toy vehicle and the side portions of the tower taken along the line 13—13 in FIG. 12, illustrating in particular the continuous racks of teeth positioned to be engaged with the rotatably driven gears of the vehicle and the cam means engaged with vehicular rod for imparting a steady substantially vertically upward movement to the toy vehicle.
Figure 13:
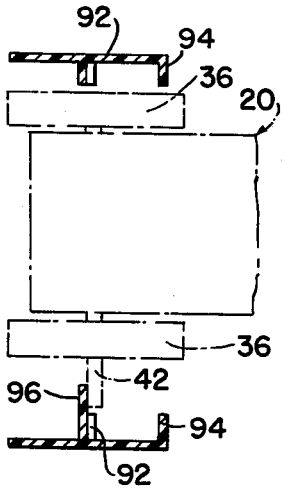

As herein embodied, at least one of the side portions 90 of the tower 88 is provided with cam means engageable with the vehicular rod 42 for imparting a steady and substantially vertically upward movement to the vehicle. As best shown in FIGS. 12 and 13, the cam means comprises a lower continuous cam rail extending from the left one of the side portions 90 of the tower 88 wherein the vehicular rod 42 rides along the lower cam rail 96 to ensure the substantially vertical movement of the vehicle upwardly.

With reference to FIG. 11, as the vehicle leaves the end of track section 32, the gears 40 of the vehicle are placed into position for engagement with the continuous racks of teeth 92 by side ramp 82, center guide rail 84, and side guide rails 86. The vehicle 20 is then moved vertically upwardly by the interaction of gears 40 and racks 92 and rod 42 with cam rail 96 until it reaches the elevated tower level 98.

As best seen in FIGS. 1 and 12, the tower 88, at the elevated level 98, further includes a ramp 100 extending from the tower. The ramp is rotatably attached to the tower and normally biased in a substantially horizontal position for movement of the vehicle 20 from the elevated level 98 of the tower onto the ramp. The biasing of the ramp can be achieved with any suitable means, such as by using a spring 102 as shown in FIG. 12. At the outer end of the ramp 100, there is further provided an upright outer plate 104 for engagement with the front end of the vehicle 20 as it moves onto the ramp.

When the vehicle is driven by the rear wheels 38 from the elevated level 98 of the tower 88 onto the ramp 100, the weight of the vehicle causes the ramp to be moved downwardly, overcoming the bias of the spring 102. As the ramp begins to move downwardly, the front end of the vehicle 20 engages with the upright outer plate 104. This combined action causes the vehicle to somersault rear end first onto the track at the bottom of the tower 88 into a normal horizontal position. This movement is best illustrated by reference to FIG. 12. To facilitate the return of the somersaulting vehicle to the normal horizontal position on the track at the bottom of the tower, track section 34 further includes resilient pad means 106 at the bottom of the tower 88 for receiving the vehicle and uprighting it onto the track. It will be apparent from FIG. 1 that the vehicle 20, after leaving the tower 88 and the track section 34, returns to the beginning portion of the continuous trackway 22 for further movement around the trackway 22 in the manner previously described.

In view of the foregoing written description of the preferred embodiment and accompanying drawings, it is seen that the vehicle 20 is imparted with various unique and different movements as it travels along the continuous trackway to various track sections 24, 26, 28, 30, 32, and 34. It is further seen that the toy vehicle and trackway can be formed in different separable parts for easy storage and assembly and is simple in construction and can be formed of a hard plastic for durability and safety of the children playing with the device. It will be apparent, however, to those skilled in the art that modifications and variations could be made in the vehicle and trackway in accordance with the teachings of the invention without departing from the spirit or scope of the invention. Thus it is intended that the present invention cover the modifications and variations of this invention within the scope of the appended claims and their equivalents.

What is claimed is:

1. An amusement device comprising:

(a) a wheeled vehicle having at least rotatably driven rear wheels and rotatably driven gears extending laterally from said vehicle; and (b) a trackway on which said vehicle moves including a first track section having at one end side ramps and teeth means positioned on said side ramps engageable with said rotatably driven gears of said vehicle for elevating the front end of said vehicle from said trackway into an upwardly extending position relative thereto, said vehicle being movably driven on said trackway by said rear wheels in the upwardly extended front-end position after leaving said side ramps and teeth means, and wherein said track section has at another end step means for imparting a change of movement to said vehicle to return the front end of said vehicle to a normal position on the trackway.

2. An amusement device comprising:

(a) a wheeled vehicle having rotatably driven gears and at least one rod extending laterally from said vehicle; and (b) a trackway on which said vehicle moves including a track section having a double-inclined tower with upstanding side portions, wherein said upstanding side portions along the first incline of said tower section are provided with continuous racks positioned to be engaged by said rotatably driven gears of said vehicle to impart upward movement to said vehicle and with at least one said upstanding side portion being provided with cam means slidably engageable with said vehicular rod for imparting a rocking movement to said vehicle as said vehicle moves upwardly, and wherein said upstanding side portions along the second incline of said tower section are provided with continuous racks positioned to be engaged by said rotatably driven gears of said vehicle to impart downward movement to said vehicle and with a first end of at least one said side portion being provided with cam means slidably engageable with said vehicular rod for imparting a steady downward movement to said vehicle wherein when said vehicular rod disengages said latter cam means, said vehicle rotates about said gears from gravity and vehicular mass momentum as said vehicle moves downwardly to said trackway at the tower bottom.

3. An amusement device comprising:

(a) a wheeled vehicle having at least rotatably driven rear wheels and rotatably driven gears extending from the sides of said vehicle; and (b) a trackway on which said vehicle moves including a track section of an S-shaped configuration having means for imparting an S-shape to the path of movement of said vehicle, said means including a series of substantially vertically-extending poles positioned along the sides of said track section to be engaged by said gears extending from said vehicle to impart an S-shaped path of movement of said vehicle along said track section.

4. An amusement device comprising:

(a) a wheeled vehicle having at least rotatably driven rear wheels, laterally extending rotatably driven gears, and at least one rod extending from said vehicle; and (b) a trackway on which said vehicle moves including a track section having at one end a side ramp engageable with the wheels on one side of said vehicle for elevating said one vehicular side from said trackway into an upwardly tilted position relative thereto, said vehicle being moved on said trackway and maintained in said tilted position after leaving said side ramp by the driven gear and wheels on the downwardly positioned other side of said vehicle, wherein said track section has at another end a side ramp engageable with the driven gear on the downward other side of said vehicle for returning the vehicle from the tilted position to a normal position on the trackway.

5. An amusement device comprising:

(a) a wheeled vehicle having at least rotatably driven rear wheels, rotatably driven gears, and at least one rod extending from said vehicle; and (b) a trackway on which said vehicle moves including a track section having a tower with side portions provided with continuous racks substantially vertically positioned to be engaged by said rotatably driven gears of said vehicle to impart upward movement to said vehicle and with at least one side portion being provided with cam means engageable with said vehicular rod for imparting a steady substantially vertically upward movement to said vehicle to an elevated level of said tower, and wherein said tower has at said elevated level a ramp extending from and rotatably attached at one end to said tower, said ramp being biased against downward movement and extending in a substantially horizontal position for movement of said vehicle from said tower onto said ramp and having an upright outer plate engageable with the front end of said vehicle to somersault said vehicle rearend first to a normal position onto the trackway at the tower bottom when the weight of said vehicle causes said ramp to move downwardly.

6. The amusement device of claim 1 wherein said vehicle further comprises at least one rod extending from said vehicle and wherein said trackway further comprises a second track section having a double-inclined tower with upstanding side portions, wherein said upstanding side portions along the first incline of said tower section are provided with continuous racks positioned to be engaged by said rotatably driven gears of said vehicle to impart upward movement to said vehicle and with at least one said upstanding side portion being provided with cam means slidably engageable with said vehicular rod for imparting a rocking movement to said vehicle as said vehicle moves upwardly, and wherein said upstanding side portions along the second incline of said tower section are provided with continuous racks positioned to be engaged by said rotatably driven gears of said vehicle to impart downward movement to said vehicle and with a first end of at least one said side portion being provided with cam means slidably engageable with said vehicular rod for imparting a steady downward movement to said vehicle wherein when said vehicular rod disengages said latter cam means, said vehicle rotates about said gears from gravity and vehicular mass momentum as said vehicle moves downwardly to said trackway at the tower bottom.

7. The amusement device of claim 6 wherein said trackway further comprises a third track section of an S-shaped configuration having a series of substantially vertically-extending poles positioned along the sides of said third track section to be engaged by said gears extending from said vehicle to impart an S-shaped path of movement of said vehicle along said third track section.

8. The amusement device of claim 7 wherein said trackway further comprises a fourth track section having at one end a side ramp engageable with the wheels on one side of said vehicle for elevating said one vehicular side from said trackway into an upwardly tilted position relative thereto, said vehicle being moved on said trackway and maintained in said tilted position after leaving said side ramp by the driven gear and wheels on the downwardly positioned other side of said vehicle, and wherein said fourth section has at another end a side ramp engageable with the driven gear on the downward other side of said vehicle for returning the vehicle from the tilted position to a normal position on the trackway.

9. The amusement device of claim 8 wherein said trackway further comprises a fifth track section having a tower with side portions provided with continuous racks substantially vertically positioned to be engaged by said rotatably driven gears of said vehicle to impart upward movement to said vehicle and with at least one side portion being provided with cam means engageable with said vehicular rod for imparting a steady substantially vertically upward movement to said vehicle to an elevated level of said tower, and wherein said tower has at said elevated level a ramp extending from and rotatably attached at one end to said tower, said ramp being biased against downward movement and extending in a substantially horizontal position for movement of said vehicle from said tower onto said ramp and having an upright outer plate engageable with the front end of said vehicle to somersault said vehicle rearend first to a normal position onto the trackway at the tower bottom when the weight of said vehicle caused said ramp to move downwardly.

10. The amusement device of claim 9 wherein said fifth track section includes a resilient pad means positioned on said trackway at the tower bottom for receiving the somersaulting vehicle and facilitating the vehicle's return to a normal position on said trackway.

11. The amusement device of claim 9 wherein said trackway further comprises a sixth track section with a series of steps in a downward slope to impart a bumpy movement to said vehicle along said trackway.

12. An amusement device comprising:

(a) a wheeled vehicle having at least rotatably driven rear wheels, rotatably driven gears extending from said vehicle, and at least one rod extending from said vehicle; and (b) a trackway on which said vehicle moves, including:

(i) a first track section having at one end side ramps and teeth means positioned on said side ramps engageable with said rotatably driven gears of said vehicle for elevating the front end of said vehicle from said trackway into an upwardly extending position relative thereto, said vehicle being movably driven on said trackway by said rear wheels in the upwardly extended front-end position after leaving said side ramps and teeth means, and wherein said track section has at another end step means for imparting a change of movement to said vehicle to return the front end of said vehicle to a normal position on the trackway;

(ii) a second track section having a double-inclined tower with upstanding side portions, wherein said upstanding side portions along the first incline of said tower section are provided with continuous racks positioned to be engaged by said rotatably driven gears of said vehicle to impart upward movement to said vehicle and with at least one said upstanding side portion being provided with cam means slidably engageable with said vehicular rod for imparting rocking movement to said vehicle as said vehicle moves upwardly, and wherein said upstanding side portions along the second incline of said tower section are provided with continuous racks positioned to be engaged by said rotatably driven gears of said vehicle to impart downward movement to said vehicle and with a first end of at least one said side portion being provided with cam means slidably engageable with said vehicular rod for imparting a steady downward movement to said vehicle wherein when said vehicular rod disengages said latter cam means, said vehicle rotates about said gears from gravity and vehicular mass momentum as said vehicle moves downwardly to said trackway at the tower bottom;

(iii) a third track section of an S-shaped configuration having a series of substantially vertically-extending poles positioned along the sides of said track section to be engaged by said gears extending from said vehicle to impart an S-shaped path of movement of said vehicle along said third track section;

(iv) a fourth track section having at one end a side ramp engageable with the wheels on one side of said vehicle for elevating said one vehicular side from said trackway into an upwardly tilted position relative thereto, said vehicle being moved on said trackway and maintained in said tilted position after leaving said side ramp by the driven gear and wheels on the downwardly positioned other side of said vehicle, and wherein said fourth section has at another end a side ramp engageable with the driven gear on the downward other side of said vehicle for returning the vehicle from its tilted side position to a normal position on the trackway; and (v) a fifth track section having a tower with side portions provided with continuous racks substantially vertically positioned to be engaged by said rotatably driven gears of said vehicle to impart upward movement to said vehicle and with at least one side portion being provided with cam means engageable with said vehicular rod for imparting a steady substantially vertically upward movement to said vehicle to an elevated level of said tower, and wherein said tower has at said elevated level a ramp extending from and rotatably attached at one end to said tower, said ramp being biased against downward movement and extending in a substantially horizontal position for movement of said vehicle from said tower onto said ramp and having an upright outer plate engageable with the front end of said vehicle to somersault said vehicle rearend first to a normal position onto the trackway at the tower bottom when the weight of said vehicle causes said ramp to move downwardly.

13. The amusement device of claim 12 wherein said trackway further comprises a sixth track section with a series of steps in a downward slope to impart a bumpy movement to said vehicle along said trackway.

14. The amusement device of claim 13 wherein said first section intersects with said sixth section, said sixth section intersects with said second section, said second section intersects with said third section, said third section intersects with said fourth section, and said fourth section intersects with said fifth section, and said fifth section intersects with said first section.

15. The amusement device of claim 13 wherein said first, third, and fourth track sections are substantially horizontal.

16. The amusement device of claim 6 or 12 wherein said rod extends from the axle of one of said vehicular rear wheels.

17. The amusement device of claim 8 or 12 wherein said fourth track section is curved.

18. The amusement device of claim 12 wherein said fifth track section includes a resilient pad means positioned on said trackway at the tower bottom for receiving the somersaulting vehicle and facilitating the vehicle's return to a normal position on said trackway.

* * * * *